US005199971A

United States Patent [19]

Akechi

[11] Patent Number: 5,199,971

[45] Date of Patent: * Apr. 6, 1993

[54] PARTS FOR USE IN ROTARY GEAR PUMP

[75] Inventor: Kiyoaki Akechi, Itami, Japan

[73] Assignee: Sumitomo Electric Industries, Ltd., Osaka, Japan

[ * ] Notice: The portion of the term of this patent subsequent to Jun. 13, 2006 has been disclaimed.

[21] Appl. No.: 452,384

[22] Filed: Dec. 19, 1989

[30] Foreign Application Priority Data

Dec. 19, 1988 [JP] Japan ..... 63-321332

[51] Int. Cl.[5] ..... C22C 21/04

[52] U.S. Cl. ..... 75/249; 419/23; 419/11; 419/13; 419/14; 419/19

[58] Field of Search ..... 75/228, 249, 230, 231, 75/232, 233, 234, 236, 237, 238, 244; 419/23, 10, 11, 13, 14, 19

[56] References Cited

U.S. PATENT DOCUMENTS 3,787,205 1/1974 Church ..... 419/48
3,791,800 2/1974 McGee ..... 29/182.5
3,897,618 8/1975 Church ..... 29/420.5
4,347,076 8/1982 Ray et al. ..... 75/0.5 R
4,702,885 10/1987 Odani et al. ..... 419/23
4,808,226 2/1989 Adam ..... 75/246
4,818,308 4/1989 Odani et al. ..... 148/437
4,838,936 6/1989 Akechi ..... 75/249

*Primary Examiner*—Donald P. Walsh
*Assistant Examiner*—Daniel Jenkins
*Attorney, Agent, or Firm*—Wenderoth, Lind & Ponack

[57] ABSTRACT

The present invention relates to parts, such as a drive gear and driven gear, for use in a rotary gear pump exhibiting good sliding characteristics against a pump case made of light metals such as aluminum alloys. These parts are obtained by subjecting aluminum alloy powders, which have been solidified at a cooling rate of 100° C./sec or more, or aluminum alloy powders having particle diameters of 350 μm or less, to powder compacting and hot extrusion and optionally further to hot forging, or subjecting the aluminum alloy powders to powder forging.

15 Claims, 1 Drawing Sheet

PARTS FOR USE IN ROTARY GEAR PUMP

FIELD OF THE INVENTION

The present invention relates to parts for use in a rotary gear pump exhibiting good sliding characteristics against a pump case formed of light metals, such as aluminum alloys. In particular it relates to parts, such as a driven gear and drive gear, for use in a rotary gear pump, where the parts are obtained by an extrusion of aluminum alloy powders, which have been rapidly solidified, and/or are obtained by a powder forging.

PRIOR ART

A drive gear (inner rotor) and a driven gear (outer rotor) in a rotary gear pump have both been formed of the same kinds of iron material in many cases.

Accordingly, difficulties have occurred in that noises and a loss of motive power are increased during operation of the rotary gear pump.

It has been pointed out that noises produced when the driven gear is engaged with the drive gear are in particularly loud. In addition, the loss of motive power results from an increased torque required during the operation.

These disadvantages have been chiefly considered to be caused by the tooth shape of the driven gear and drive gear and an error in this tooth shape. Accordingly, also countermeasures against them have been considered merely in view of such matters, so that no effective solution has been achieved.

So, the present inventor has investigated the material of the driven gear and drive gear and a reduction of noises and their weight, aiming at a reduction of the noises and loss of motive power, thereby proposing use of light metals, such as aluminum alloys, and sintered alloys, such as ceramics, having small specific densities as one method of reducing the weight of the gears (Japanese Patent Laid Open No. Sho 60-128983).

PROBLEMS TO BE SOLVED BY THE INVENTION

The conventional drive gear and driven gear formed of sintered aluminum alloys are superior in abrasion and sliding characteristics in the case where a pump case is formed of iron materials, so that no problem has occurred. But, if the pump case is formed of light metals, such as aluminum alloys, to reduce the weight of the pump, the pump case for example sticks to the driven gear to produce an increased abrasion, causing a problem in the sliding characteristics.

In addition, a similar problem is apt to occur also between the driven gear and the drive gear.

MEASURES FOR SOLVING THE PROBLEMS

The present inventor has investigated the obtainment of parts, such as driven gear and drive gear, for use in a rotary gear pump formed of aluminum alloys capable of solving the above described problems, thereby achieving the present invention.

That is to say, the present invention provides parts, such as a driven gear superior in sliding characteristics against a pump case formed of light metals, and drive gear superior in sliding characteristics against said driven gear, formed of aluminum alloy materials. These parts are obtained by subjecting aluminum alloy powders, which have been solidified at a cooling rate of 100° C./sec or more, or aluminum alloy powders having particle diameters of 350 μm or less, to powder compacting and hot extrusion and optionally further to hot forging, or subjecting the aluminum alloy powders to powder forging.

OPERATION

The present invention will be described below in detail.

Figure 1:
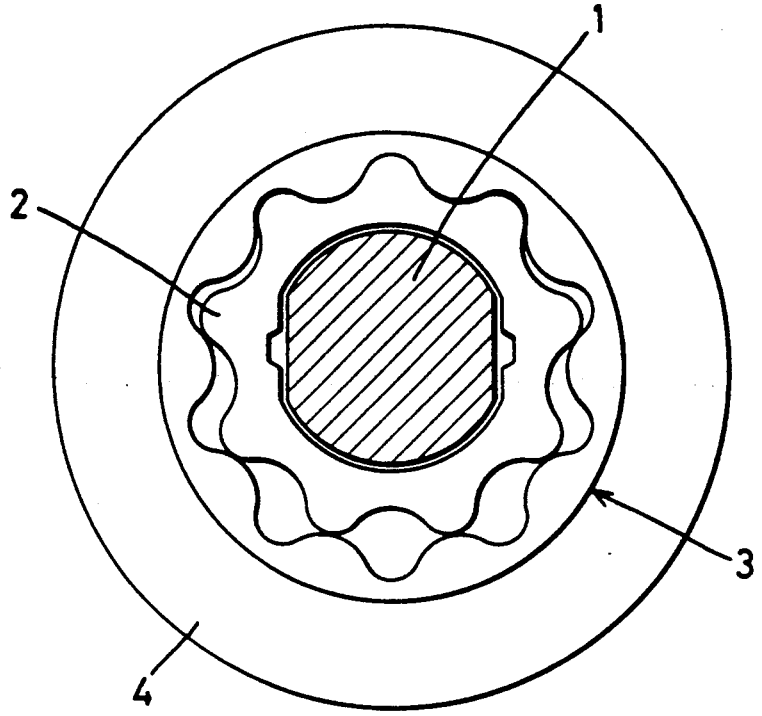
FIG. 1 is a plan view showing an inscribed type trochoidal toothed pump.

FIG. 1 is a plan view showing an inscribed type trochoidal toothed pump as one example of a rotary gear pump.

In this rotary gear pump, a drive gear (inner rotor) 2 is driven by a drive shaft 1 and a driven gear (outer rotor) 3 is driven with by said drive gear 2.

This driven gear 3 is housed in a space formed in a pump case 4. A fluid is sucked through a suction port (not shown) and discharged through an exhaust port by the rotation of the drive gear 2 and the driven gear 3.

According to the present invention, materials are prepared by the use of aluminum alloy powders, which have been rapidly solidified, and the driven gear and drive gear are produced of said materials.

The aluminum alloy powders, which have been rapidly solidified, are usually produced by the atomizing method. In the air atomizing method, the cooling rate is 100° C./sec or more. Or, if aluminum alloy powders have particle diameters of 350 μm or less, they are powders which have been rapidly solidified and then screened to this particle size.

It is preferable that the cooling rate is 1000° C./sec or more and the particle diameter is 150 μm or less.

Aluminum alloys with a large amount of alloy element added, which have never been obtained by usual materials (cast materials, wrought materials) obtained by an ingot metallurgical process, can be obtained by rapid solidification. In addition, a uniform and fine structure can be obtained For example, in order to improve the Al—Al sliding characteristics, alloys containing Si in a quantity of 12 to 42% and transition metals, such as Fe and Ni, in a quantity of 1 to 12% can be obtained.

Si crystals and intermetallic compounds of these alloys (powder-extruded materials and powder-forged materials) have sizes of 20 μm or less. Accordingly, these alloys exhibit both a high abrasion and wear resistance, high Young's modulus and low thermal expansion coefficient due to a high content of alloy elements and superior mechanical properties, such as high strength and high heat resistance, and a superior machinability due to the absence of segregation and uniform and fine microstructure in spite of a high content of alloy elements.

Also the above described alloys with hard particles and self-lubricating particles dispersed therein can be produced depending upon the conditions under which they are used.

In order to improve the sliding characteristics against the light metals, such as aluminum alloys, of the pump case, the quantity of Al atoms on the sliding surface which are easily cohesive with each other is reduced as far as possible.

That is to say, alloys containing a large amount of covalent-bonding Si crystal and intermetallic compound ($Al_3Fe$, $Al_3Ni$ and the like) are obtained.

However, the conventional aluminum alloys have Si contained therein in a quantity of at most 12% and if the cast product is simple in shape, they contain Si in a quantity of at most 17% and Fe in a quantity of at most 1%.

It is the use of aluminum alloy powders, which have been rapidly solidified, that has overcome such limitations about the quantities of Si and transition metals such as Fe.

The aluminum alloy powders, which have been rapidly solidified, are subjected to CIP compacting to form a billet which is subjected to hot extrusion to obtain the material for making the pump parts.

Or, the materials are obtained also by molding the powders in a die cavity, removing the binder and then subjecting the powder compacting to hot powder forging. In every case, the near net shape can be obtained but the dimensional accuracy is not satisfactory, so that subsequent machining is required.

Figure 2:
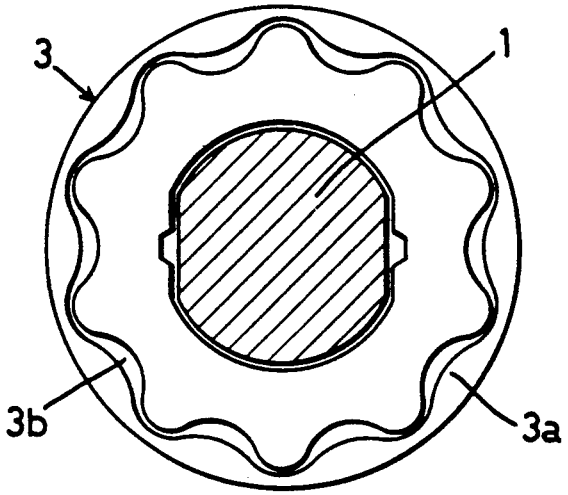
FIG. 2 is a plan view showing a driven gear composed of 2 layers formed of different materials.

In every case of the powder extrusion method and the powder forging method, as shown in FIG. 2, particularly in the driven gear 3, a side 3*a* brought into contact with the pump case and a side 3*b* brought into contact with the drive gear can be formed of materials compatible with to the respective other parts in a double-layer structure.

In addition, the materials are made of powder, so that a powder mixture comprising two or more kinds of different powder, which have been rapidly solidified, a powder mixture with ceramics particles, such as $Al_2O_3$ powders, $SiO_2$ powders, $Si_3N_4$ powders and SiC powders, added, a powder mixture with self-lubricating particles, such as graphite, BN and $MoS_2$, added, or mixtures comprising all the above described materials can be prepared by powder extrusion and powder forging.

It goes without saying that in the event that the required characteristics are not satisfied even by the use of the aluminum alloy powders, which have been rapidly solidified, surface treatments similar to those for the usual aluminum alloys, for example the anodizing treatment, the plating treatment and the coating with fluorine resins, can be adopted.

In this case, the thermal expansion coefficient of the materials obtained by the powder extrusion and the powder forging is reduced to that of iron due to a high content of Si added. Various characteristics, such as high Young's modulus, high strength in spite of a high content of alloy elements, and good machinability, are maintained.

PREFERRED EMBODIMENTS

The present invention will be described below with reference to preferred embodiments.

The respective combinations of the driven gear and the drive gear formed of the materials shown in Table 1 and having an outside diameter of 80 mm and a wall thickness of 10 mm were subjected to a pump test for 20 hours at 4,000 rpm.

After the test, the surface state of the gears was investigated with the results that a remarkably good surface state is obtained when the driven gear and drive gear according to the present invention are used.

TABLE 1

| | | No | Pump case | Driven gear | Drive gear | Surface state |
|---|---|---|---|---|---|---|
| Present invention | Aluminum alloy produced by powder-extrusion or powder forging | 1 | A2017 | #250 | #250 | ○ |
| | | 2 | #250 | #250 | #250 | ○ |
| | | 3 | ACD12 | #210 | A4032 | ○ |
| | | 4 | A 390 | #125 + 4% graphite + 3% SiC | #125 | ○ |
| | | 5 | A2017 | #210 coated with fluorine resins | #210 | ○ |
| COMPARATIVE EXAMPLE | Aluminum alloy produced by ingot metallurgy | 6 | A2017 | A2017 | A2017 | Cohesive abrasion |
| | | 7 | ACD12 | A4032 | A4032 | Cohesive abrasion |
| | | 8 | A 390 | A 390 | A 390 | Cohesive abrasion |
| | | 9 | A2017 | A 390 | A4032 | Cohesive abrasion |
| | | 10 | A 390 | A2017 | A 390 | Cohesive abrasion |
| | Iron | 11 | Cast iron (FCA) | Sintered iron alloys | Sintered iron alloys | ○ |

(Notes)
Symbols in the above Table designate the following contents:
A2017: aluminum alloy produced by ingot metallurgy (duralumin Al—4% Cu—0.6% Mg—0.6% Mn)
ACD12: aluminum alloy produced by ingot metallurgy (Al—11% Si—2.5% Cu—0.2% Mg—0.2% Mn)
A4032: aluminum alloy produced by ingot metallurgy (Al—12% Si—1% Cu—1% Mg—1% Ni)
A 390: aluminum alloy produced by ingot metallurgy (Al—17% Si—4% Cu—1% Mg)
#250: aluminum alloy produced by powder extrusion or powder-forging (Al—20% Si—5% Fe—2% Ni)
#210: aluminum alloy produced by powder extrusion or powder-forging (Al—12% Si—5% Fe—3% Cu—1% Mg—0.4% Mn)
#125: aluminum alloy produced by powder extrusion or powder-forging (Al—25% Si—3% Cu—0.5% Mg—0.4% Mn)

EFFECTS OF THE INVENTION

As above described, according to the present invention, the sliding characteristics between the pump case and the driven gear and the sliding characteristics between the driven gear and the drive gear can be remarkably improved by forming the driven gear and the drive gear of the materials obtained by subjecting the aluminum alloy powders, which have been rapidly solidified, or the aluminum alloy powders having particle sizes of 350 μm or less to the powder compacting followed by the hot extrusion or further the hot forging or the powder forging. The use of the above described materials in parts for a pump and the like is effective.

What is claimed is:

1. A part for use in a rotary gear pump, having good sliding characteristics against a pump case made of light metals, said part being formed of aluminum alloy material obtained by subjecting aluminum alloy powders, which have been rapidly solidified at a cooling rate of 1000° C./sec or more and have particle sizes of 150 μm or less, to powder compacting and then to hot extrusion, wherein the aluminum alloy material contains a substantial amount of covalent-bonding Si crystal and an intermetallic compound containing aluminum to reduce the quantity of Al atoms on the sliding surface of the part which are cohesive with each other, and wherein a surface of the part is plated or coated with a fluorine resin.

2. The part for use in a rotary gear pump as set forth in claim 1, which part is a driven gear or a drive gear.

3. The part for use in a rotary gear pump as set forth in claim 1, wherein said aluminum alloy powders contain a member selected from the group consisting of ceramic particles, graphite particles and a mixture thereof.

4. The part for use in a rotary gear pump as set forth in claim 1, wherein a surface of the part is plated.

5. The part for use in a rotary gear pump as set forth in claim 1, wherein a surface of the part is coated with a fluorine resin.

6. A part for use in a rotary gear pump, having good sliding characteristics against a pump case made of light metals, said part being formed of aluminum alloy material obtained by subjecting aluminum alloy powders, which have been rapidly solidified at a cooling rate of 1000° C./sec or more and have particle sizes of 150 μm or less, to powder forging, wherein the aluminum alloy material contains a substantial amount of covalent-bonding Si crystal and an intermetallic compound containing aluminum to reduce the quantity of Al atoms on the sliding surface of the part which are cohesive with each other, and wherein a surface of the part is plated or coated with a fluorine resin.

7. The part for use in a rotary gear pump as set forth in claim 6, which part is a driven gear or a drive gear.

8. The part for use in a rotary gear pump as set forth in claim 6, wherein said aluminum alloy powders contain a member selected from the group consisting of ceramic particles, graphite particles and a mixture thereof.

9. The part for use in a rotary gear pump as set forth in claim 6, wherein a surface of the part is plated.

10. The part for use in a rotary gear pump as set forth in claim 6, wherein a surface of the part is coated with a fluorine resin.

11. A part for use in a rotary gear pump, having good sliding characteristics against a pump case made of light metals, said part being formed of aluminum alloy material obtained by subjecting aluminum alloy powders, which have been rapidly solidified at a cooling rate of 1000° C./sec or more and have particle sizes of 150 μm or less, to powder compacting and then hot extrusion and further to hot forging, wherein the aluminum alloy material contains a substantial amount of covalent-bonding Si crystal and an intermetallic compound containing aluminum to reduce the quantity of Al atoms on the sliding surface of the part which are cohesive with each other, and wherein a surface of the part is plated or coated with a fluorine resin.

12. The part for use in a rotary gear pump as set forth in claim 11, which part is a driven gear or a drive gear.

13. The part for use in a rotary gear pump as set forth in claim 11, wherein said aluminum alloy powders contain a member selected from the group consisting of ceramic particles, graphite particles and a mixture thereof.

14. The part for use in a rotary gear pump as set forth in claim 11, wherein a surface of the part is plated.

15. The part for use in a rotary gear pump as set forth in claim 11, wherein a surface of the part is coated with a fluorine resin.

* * * * *